United States Patent [19]

Cutler

[11] 4,124,325

[45] Nov. 7, 1978

[54] ASPHALT PAVEMENT RECYCLING APPARATUS

[75] Inventor: Earl F. Cutler, Lawrence, Kans.

[73] Assignee: Cutler Repaving, Inc., Lawrence, Kans.

[21] Appl. No.: 823,935

[22] Filed: Aug. 12, 1977

Related U.S. Application Data

[63] Continuation-in-part of Ser. No. 645,928, Dec. 31, 1975, abandoned.

[51] Int. Cl.[2] ..... E01C 7/06

[52] U.S. Cl. ..... 404/75; 404/118; 404/90; 404/95

[58] Field of Search ..... 404/75, 90, 91, 114, 404/118, 95, 77

[56] References Cited

U.S. PATENT DOCUMENTS

| | | | |
|---|---|---|---|
| 1,390,479 | 9/1921 | Baker | 404/120 X |
| 2,053,709 | 9/1936 | Flynn | 404/90 X |
| 2,093,766 | 9/1937 | Rich | 404/118 X |
| 2,150,326 | 3/1939 | Jackson | 404/115 |
| 2,306,124 | 12/1942 | Jackson | 404/114 |
| 2,332,687 | 10/1943 | Baily | 404/115 |
| 2,394,017 | 2/1946 | Seaman | 404/95 |
| 2,747,475 | 5/1956 | West | 404/95 X |
| 2,914,994 | 12/1959 | Pollitz | 404/118 X |
| 3,055,280 | 9/1962 | Neville | 404/95 |
| 3,361,042 | 1/1968 | Cutler | 404/90 X |
| 3,825,361 | 7/1974 | Steiner | 404/90 |

*Primary Examiner*—Nile C. Byers, Jr.

*Attorney, Agent, or Firm*—Olson, Trexler & Wolters

[57] ABSTRACT

Disclosed is a method and apparatus for recycling asphalt concrete roadways. The apparatus includes means for heating the roadway and applying emulsified asphalt thereto prior to scarifying the heated surface. The surface is then scarified so as to loosen the heated asphalt. The scarified material is then treated with asphalt and, if desired, a rejuvenating agent. They are mixed thoroughly to form a hot mix of asphalt concrete from the old road material. New material is added, and mixed with the old material by a pug mill rotor. The combined rejuvenated hot mix is further mixed and leveled by means of screws and then compacted substantially by a vibrating screed. The screed has a continuous bottom plate and a plurality of relatively movable upper sections which are connected by turnbuckles adapted to be adjusted for bending the bottom plate of the screed to conform to the contour of the road crown. Final compaction of the road surface is obtained by rollers.

14 Claims, 15 Drawing Figures

107
182
191
227
179
56d
221
216a
216b
202
223
109
220
190
229
222
188
226
178
56c
56
187
201
115
184
177
56b
183
200
181
176
56a
180
216
218
217
212
210
213
211
207
204
209
206
106
106a
106d
106c
106b
108
248
250
244
247
242
246
240
243
249
241
216a
216b
171
116

ASPHALT PAVEMENT RECYCLING APPARATUS

REFERENCE TO RELATED CASE

This application is a continuation-in-part of copending application Ser. No. 645,928, filed Dec. 31, 1975 and now abandoned.

BACKGROUND OF THE INVENTION

This invention relates generally to roadway resurfacing apparatus, and more particularly to new and improved asphalt concrete recycling methods and apparatus for rejuvenation of old roadway surfaces. Accordingly, this invention deals with substantial improvements in the forming and handling of rejuvenated roadway surfaces during road repaving operations.

Road resurfacing apparatus, in general, as set forth in Cutler U.S. Pat. No. 3,361,042, provides means for quickly and inexpensively resurfacing roadways made of asphalt-concrete material. The size of the apparatus disclosed therein is on the order of about eight to ten feet wide and approximately forty to fifty feet long and is intended to move along the roadway at a slow rate of speed so that during a single continuous pass, the old road surface is excavated and combined with additional hot mix to form a new road surface. During the conversion of the old road surface to the new road surface, new asphalt concrete mixtures are required to be added to excavated material. This is to compensate for missing material as a result of pot holes in the road and to provide a thicker road surface.

A specific problem with prior art road resurfacing apparatus is that the leading edge of the leveling screed is subjected to a relatively high degree of wear. In many cases the upwardly turned leading edge of the screed wears through, thereby allowing the hot mix of asphalt concrete to enter the interior of the screed. When this happens the new road surface is not leveled and compacted properly and the screed must be replaced. Therefore, the road resurfacing operation must stop for a relatively long period of time while the entire screed is replaced.

SUMMARY OF THE INVENTION

In accordance with this invention, the road repaving apparatus disclosed herein provide means for completely rejuvenating old road surfaces without requiring large amounts of new hot mix. The road repaving method disclosed herein eliminates the necessity of changing the height of the shoulder or curbing along the sides of the road as the road surface elevation is not changed. Also the road repaving apparatus disclosed herein includes a new screed structure which provides a multitude of wear surfaces which can be easily changed in a minimum of time when necessary.

Briefly, the road repaving apparatus of this invention provides means for heating the pavement surface with propane fired emitters which generate radiant rays to penetrate the black asphalt concrete without burning the pavement or polluting the atmosphere. The apparatus may include means for applying a thin film of asphalt to the heated pavement. Means are also included for scarifying the heated surface with air-bag operated carbide-tipped scarifiers which penetrate and excavate the entire surface to a depth of approximately ¾ inch. Spraying means is provided for applying asphalt over the loosened, heated, scarified surface. This asphalt may be in an emulsion or it may be liquified by heating. A spray of rejuvenating agent may be applied (in certain instances) to the mixture if desired. The excavated material is then gathered and mixed by leveling screws and blades which are equipped for transverse mixing and conveying of the rejuvenated hot mix. Additional hot mix is added by a conveyor, and the new and old hot mixes are comingled by a pug mill rotor. Leveling screws or augers are arranged to move the material laterally from side to side while mixing the excavated material with the new asphalt material. Means are provided for spreading the new hot mix in front of a vibrating screed, this means generally including a second set of mixing screws or augers.

The rejuvenated hot mix material is laid in front of a vibrating screed which operates to compact the rejuvenated material to more than 85% compaction. Additional heaters may be provided in front of the screed to insure that the mix is hot for proper compaction. To this partially compacted surface may be applied a single layer of coated, lightweight, nonskid, synthetic aggregate. This is then ultimately compacted by a conventional roller. In accordance with one aspect of the invention the vibrating screed is formed in sections and is adapted to be bent in accordance with the radius of curvature of the road cross section or crown.

In accordance with another and important aspect of this invention, the screed has a removable, leading edge member which functions as the initial leveling edge of the screed which has a tendency to wear during normal operations. The member is adapted to be removed and rotated and then replaced to provide new forward wear surfaces for the screed.

Many objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENT

Figures 1, 2, 3:
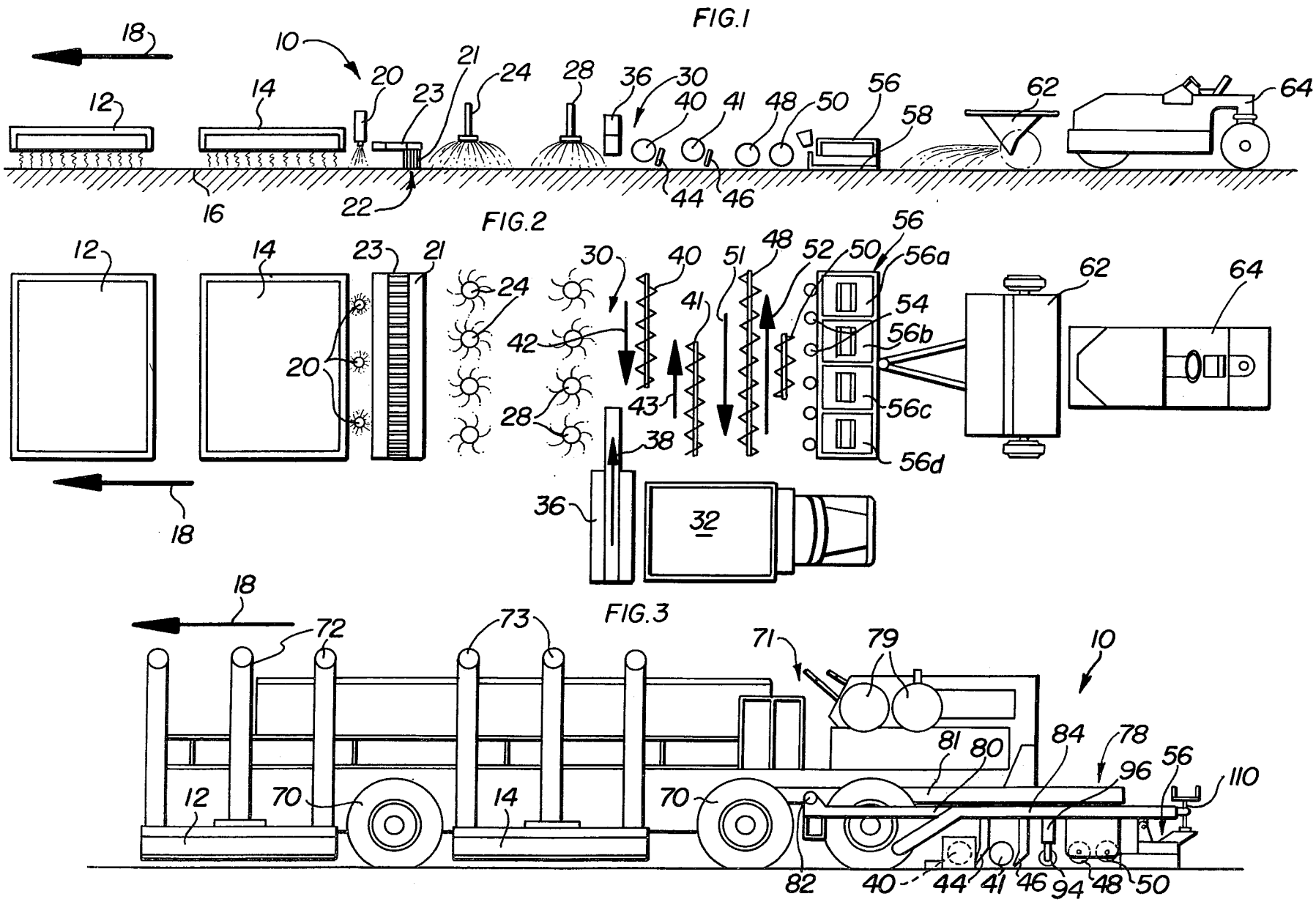
FIG. 1 is a side elevational view schematically showing the various work stations and steps of operation of the road resurfacing apparatus of this invention.
FIG. 2 is a top view of the schematic showing of FIG. 1.
FIG. 3 is a side elevational view of a road recycling machine wherein the various work stations shown schematically in FIGS. 1 and 2 are located.

Referring now to FIGS. 1 and 2, there is seen a schematic arrangement of the work stations associated with a road repaving machine which is constructed in accordance with the principles of this invention and which is designated generally by reference numeral 10. The road repaving machine 10 includes a pair of spaced-apart radiant heating units 12 and 14 located near the front end thereof to provide heating of the pavement surface 16. The radiant heating units 12 and 14 are operated by a fuel mixture comprising propane and air of the appropriate proportions. The propane-air fuel mixture is applied to a plurality of radiant heating burners or elements within the units to generate uniform radiant rays over the area covered by the heating units. These rays are directed toward the black asphalt cement of the pavement surface 16, and penetrate to a depth of between one to three inches without burning the asphalt cement or polluting the surrounding atmosphere. The radiant heating units 12 and 14, as well as the radiant heating burners mounted therein, can be constructed substantially as set forth in my earlier U.S. Pat. No. 3,865,098 which issued Feb. 11, 1975.

The direction of travel of the road repaving machine 10 is indicated by an arrowed line designated by reference numeral 18. Immediately following the heating operation of the pavement surface by the radiant heat of the units 12 and 14, a quantity of asphalt may be applied to the heated pavement surface by means of a plurality of spaced-apart nozzles 20, if desired or if road conditions require. Thus a thin film of asphalt is applied to particles which are to be excavated from the road surface for forming a rejuvenated hot mix.

The excavation of the road surface is accomplished by scarifying blades 21 which are located at a scarifying station 22 of the road repaving apparatus 10. Preferably, the scarifying blades 21 are urged against the road surface by means of air-operated bags which apply pressure to scarifying blade holding arms 23. The scarifying blades 21 excavate the heated and coated road surface to a depth of between one-half inch to 3 inches, and preferably in the order of about ¾ inch to 1½ inches. The scarifying blades 21 can be carbide tipped for maximum wear resistance. The scarifying blade and air bag operating controls are described and illustrated in my copending application Ser. No. 467,067, filed May 6, 1974, now U.S. Pat. No. 3,907,450.

Immediately following the excavation of the road surface by the scarifying blades 21, a second quantity of emulsified or heated asphalt is applied to the now loose and heated surface. This asphalt, sometimes commonly referred to as liquid asphalt, restores the adhesion property of the asphalt aggregate which is to be recombined to form the reclaimed or rejuvenated hot mix for the road surface. The asphalt is applied to the excavated surface by means of a plurality of rotating liquid dispensers 24 which are immediately behind the scarifying blades 21. Preferably the dispensers 24 receive liquid asphalt from the same container as the nozzles 20.

A quantity of rejuvenator liquid is also applied to the excavated asphalt material by means of a plurality of rotating dispensers 28. The rejuvenator liquid restores the flexibility to the asphalt concrete mix. The combination of the excavated road surface together with the liquid asphalt and the rejuvenator liquid provides a hot mix of asphalt material which conforms substantially to the characteristics of new hot mix normally used for paving and repaving roadways.

If a quantity of new hot mix asphalt concrete is required or desired, it can be supplied at the work station designated generally by reference numeral 30 which is located immediately following the rejuvenating applicators 28. The work station 30 receives a new quantity of hot mix from the side of the repaving machine 10 by means of a dump truck which is designated generally by reference numeral 32 which delivers the new hot mix asphalt concrete material therein to a portable conveyor 36. The conveyor 36 moves the material in the direction indicated by an arrow 38 in FIG. 2 to the work station 30. Also at the work station 30 a quantity of anti-skid chips may be added to the reclaimed hot mix if desired. The conveyor 36 may be carried by the truck 32 or it may be moved manually on its own wheels.

Immediately following the formation of the rejuvenated hot mix and the addition of any new hot mix, the material is further mixed and leveled by a pair of mixing screws 40 and 41 which traverse the rejuvenated hot mix first in the direction indicated by arrow 42 and then in the direction indicated by arrow 43. Associated with each of the mixing screws are leveling blade 44 and 46 respectively. The newly formed rejuvenated hot mix together with whatever amounts of new hot mix have been added is thoroughly mixed to combine the loosened aggregate and the liquid asphalt and rejuvenator. This operation is followed by a second pair of mixing and spreading screws 48 and 50 which move the reclaimed hot mix first in the direction indicated by arrow 51 and then in the direction indicated by arrow 52. This operation uniformly disperses the reclaimed hot mix together with whatever new hot mix has been added. If necessary, additional heat is applied to the mix by means of a plurality of independent heating units 54 which enable the material to be more easily compacted and shaped by means of a formable vibrating screed 56.

The screed 56 is formed of a plurality of sections **56*a*, 56*b*, 56*c* and 56*d*. These sections are interconnected by turnbuckles and rods, to be described in greater detail hereinbelow. These turnbuckles and rods enable the lower surface 58** of the screed to be shaped in conformity with the contour of the road surface being formed. Most advantageously, the vibrating screed compacts the reclaimed, rejuvenated, hot mix to a compaction of more than 85%. However, it will be understood that the degree of compaction achieved at this work station can vary widely without departing from the spirit and scope of the novel concepts of this invention.

If desired, the road surface may be provided with a scattered single layer of coated lightweight nonskid synthetic aggregate. This aggregate material is dispensed from a hopper and spreader 62 over the substantially completely compacted road surface. The amount of coated chips applied to the newly formed road surface may be on the order of about 3 pounds of aggregate chips per square yard of road surface. However, other amounts may be dispensed if desired. The road surface is ultimately compacted by a roller vehicle 64 which applies substantial weight per unit area of road surface to achieve 100% compaction of the newly rejuvenated asphalt concrete material.

Referring now to FIG. 3, there is seen a side elevational view of a road repaving machine constructed in accordance with the principles of this invention and wherein the plurality of work stations illustrated schematically in FIGS. 1 and 2 are located. The repaving machine 10 has the forward burner 12 separated from the second or rearmost burner 14 by wheels 70 and associated undercarriage structure of the repaving apparatus. The wheels 70 are steerable by hydraulic steering means from a central operating station 71. Also, if desired, the area between the wheels 70 may include scarifying apparatus (not shown) to perform an initial excavation in the road surface before the second heater 14 applies radiant heat thereto. The heating units 12 and 14 include a plurality of exhaust stacks 72 and 73, respectively, through which the products of combustion from the burners are expelled.

The road repaving apparatus 10 includes a rear lower frame structure 78 which supports the mixing and leveling screws 40, 41, 48 and 50. Also at the end of the support frame 78 is secured the compacting vibrating screed 56. The road repaving machine 10 also includes a plurality of containers 79 for supplying liquid such as diesel fuel for diesel engines used to power the machine, propane fuel for burners 12 and 14, water for cooling various components of the apparatus when necessary, liquid asphalt and rejuvenating materials.

Figure 4:
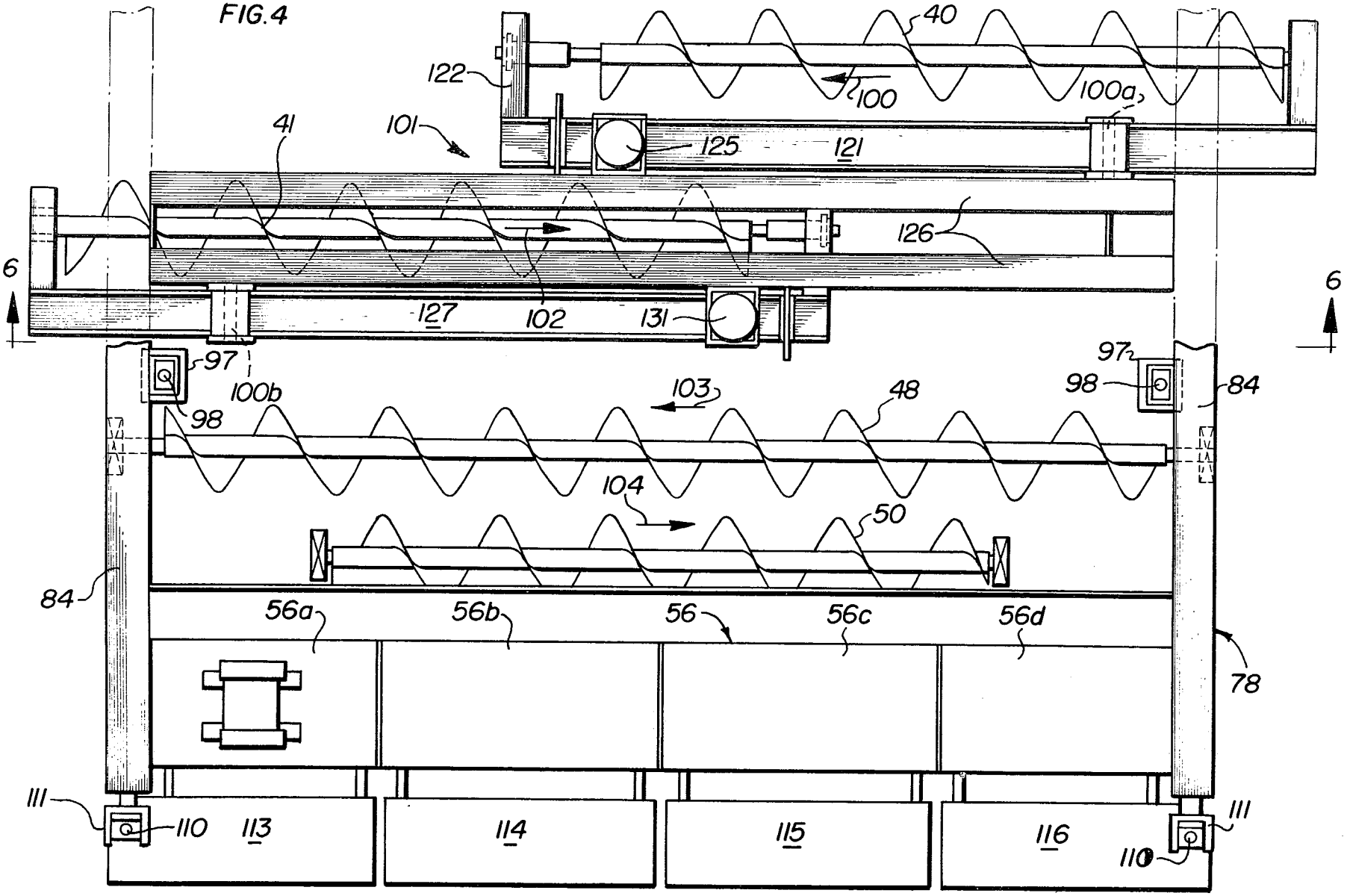
FIG. 4 is a top view of a mixer and leveler apparatus constructed in accordance with the one aspect of this invention and located within the machine of FIG. 3.
Figure 5:
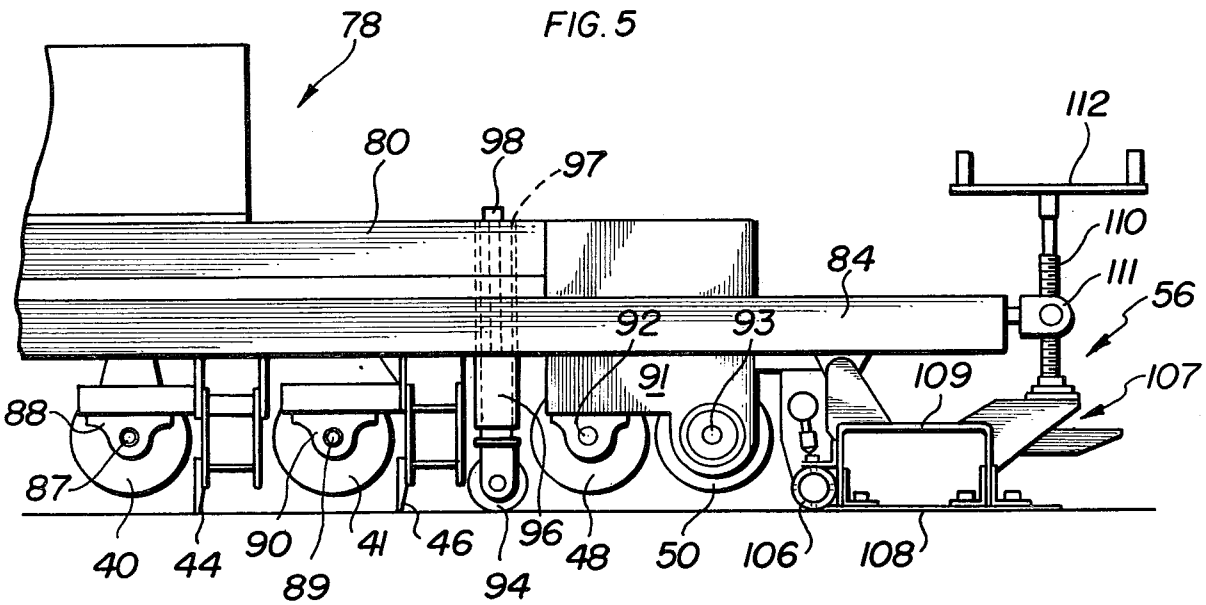
FIG. 5 is a side view of the mixer and leveler apparatus of FIG. 4.

Referring now to FIGS. 3, 4 and 5, there is seen the details of construction of the leveling and mixing screws 40, 41, 48 and 50. Also some of the details of the support frame 78 are shown. The support frame 78 includes an elongated fixed member 80 secured to the chassis of the repaving apparatus which is indicated generally by the reference numeral 81. The member 80 is pivotally secured to the chassis 81 by a pin means 82 or other suitable fastening means. An associated member 84 is adjustable relative to the member 80 and includes means for adjusting the relative positions of the mixing screws 40 and 41 and with the associated back-up blades 44 and 46.

The mixing screw 40 is journalled at its ends by bearing means 87 which may be secured to a flange or other suitable means 88. Similarly, the mixing screw 41 is journalled by bearing means 89 secured within a flange or bearing support 90. On the other hand, both screws 48 and 50 are secured to the elongated member 80 by means of plates 91 on opposite sides of the frame structure. The plates 91 receive means for carrying a pair of bearings 92 and 93 for journalling the auger type mixing screws at their ends. A leveling wheel 94 is secured to an adjustable member 96, which, in turn, is inserted into a guide 97. The adjustable member 96 includes a threaded rod 98 secured to the elongated member 80. The vertical position of the mixing and leveling screws 48 and 50 can be adjusted by raising and lowering the guide roller 94 by means of the threaded rod 98. To compensate for the crown or cross-sectional curvature of the road, the leveling blades 44 and 46 are pivotally secured to the frame by pins 100*a* and 100*b*, respectively.

As best seen in FIG. 4, the excavated, rejuvenated hot mix of both old and new origin is conveyed by the mixing screw 40 in the direction as indicated by the arrow 100 to an area 101 immediately in front of the next auger mixing screw 41. The auger or mixing screw 41 conveys the rejuvenated hot mix in the direction of arrowed lines 102 where it leaves the screw in an area immediately adjacent the auger screws 41 and behind the auger screw 40. The blades 44 and 46 cause substantial amounts of the material to pile up within their associated auger screws to insure the desired mixing action.

As the repaving apparatus advances forward, the piled rejuvenated hot mix is then agitated and dispersed by the leveling screw 48 wherein the material is directed in the direction of arrowed lines 103. The rejuvenated hot mix is again subjected to mixing and leveling by the auger 50 which moves the material in the direction as indicated by arrowed lines 104. Since there are no blades associated with the screws or augers 48 and 50, the piling is minimized and substantial leveling is accomplished.

Figure 7:
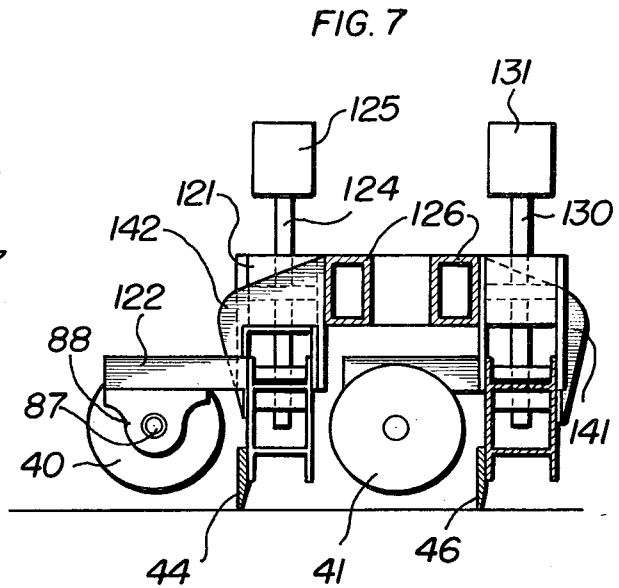
FIG. 7 is a sectional view taken substantially in the plane of line 7—7 in FIG. 6.
Figure 6:
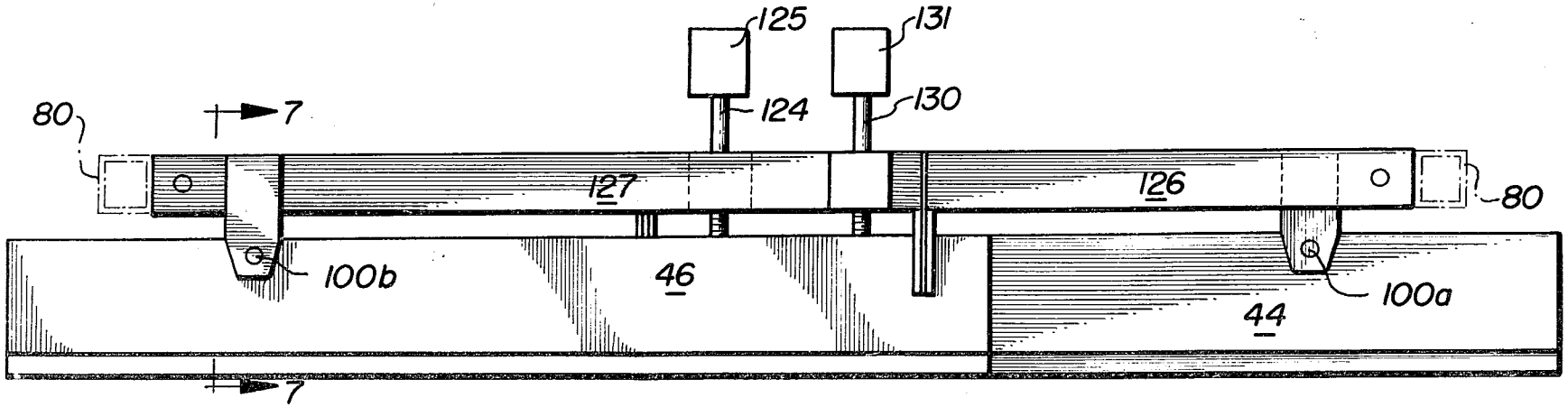
FIG. 6 is a sectional view taken substantially in the plane of line 6—6 in FIG. 4.

Referring now to FIGS. 4, 6 and 7, the details of construction of the forward mixing and leveling screws and associate leveling blades are shown. As explained above, the leveling auger screw 40 is journalled by a bearing 87 in a support 88. As seen in FIG. 7, the bearing 87 is secured to a beam 121 by means of an arm 122. Preferably, location of the beam 121 can be altered by an adjusting screw 124 or the like to provide a crown control adjustment for the cross-section of the road surface. The adjusting screw 124 may either be rotated manually or by means of an electric motor 125 operated by a suitable control circuit.

As can be envisioned from FIGS. 6 and 7 the beam 121 is pivotally secured by means of the pin 100*a* which is connected to a support frame 126 fixed to the upper support beam 80. The rotating auger screw 40 and with its leveling blade 44 therefore pivot about the pin 100*a* by means of the adjusting screw 124. Similarly, the auger screw 41 together with its leveling blade 46 are pivotally secured to the frame 126 by the pin 100*b* which, in turn, is secured to a beam 127. The beam 127, together with the associated auger screw 41 and leveling blade 46 are pivotally adjustable about the pin 100*b* by an adjusting screw 130, which also may be either manually operable or driven by a motor 131 in response to suitable control circuitry.

During machine operation, arms 141 and 142 (FIG. 7) enable the associated beams 121 and 127 to move upwardly and downwardly in response to action of the adjusting screws 124 and 130. Also, the arms 141 and 142 provide a back-up support for the leveling blades 44 and 46 as they are urged against the mass of rejuvenated hot mix asphalt concrete material. While a single specific embodiment is illustrated herein for providing crown control of the rejuvenated hot mix formed by the repaving machine of this invention, it will be understood that other suitable crown control means can be incorporated if desired.

In accordance with another aspect of this invention, each section 56*a*–56*d* of the screed 56 includes an initial leading edge member formed by a hollow pipe 106 which is secured to the screed body designated generally by reference numeral 107, as shown in FIGS. 4, 5 and 8–11 inclusive. The screed body 107 includes a bottom plate 108 extending the width of the screed and U-shaped upper members 109 forming front, rear and top walls for each of the sections 56*a*–56*d*. As shown in FIG. 5, the screed 56 is urged downwardly by means of an adjusting screw 110 which engages a threaded coupling 111 extending from the elongated member 84. A hand crank 112 is provided for adjusting the level of the screed as well as the amount of pressure or force transferred from the elongated member 84 to the screed for compacting the newly laid road surface. The screed 56 includes standing walks or platforms 113, 114, 115 and 116 associated with the sections 56*a*, 56*b*, 56*c* and 56*d*, respectively. The standing platforms enable workmen to stand immediately behind the screed and operate the adjusting screws 110 and other equipment to insure that a uniform road surface is formed. Also, it will be noted that the pipe 106 forming the leading edge of each screed section is heated by the heating apparatus 54 to insure that the hot mix is sufficiently flowable under pressure to facilitate compacting of the material.

Referring more particularly to FIGS. 8–11, there are seen the details of construction of the screed 56 utilized in the road repaving apparatus 10. The leveling screed 56 is adjustable along its width to provide an arcuate surface configuration conforming to the crown of the road as formed initially by the leveling blades 44 and 46. The screed is vibrated by a plurality of motor driven vibrators 160, 161, 162, 163, 164 and 165. Each vibrator 160–165 preferably rotates in a direction opposite to that of the adjacent vibrators. For example, the vibrators 160, 162 and 164 may rotate in a clockwise direction while vibrators 161, 163 and 165 may rotate in a counter-clockwise direction, when viewing the screed from the rear of the apparatus.

A heating chamber 167 is provided immediately over the pipe leading edge 106 of the screed and wherein the plurality of heating units 54 (FIGS. 1 and 2) are located. The heating chamber 167 has a pair of exhaust stacks 168 and 169 extending upwardly therefrom to remove the products of combustion. Preferably, the heating units are of the radiant heating type similar to those utilized in the heating units 12 and 14 and disclosed in Cutler U.S. Pat. No. 3,685,098.

Figure 8:
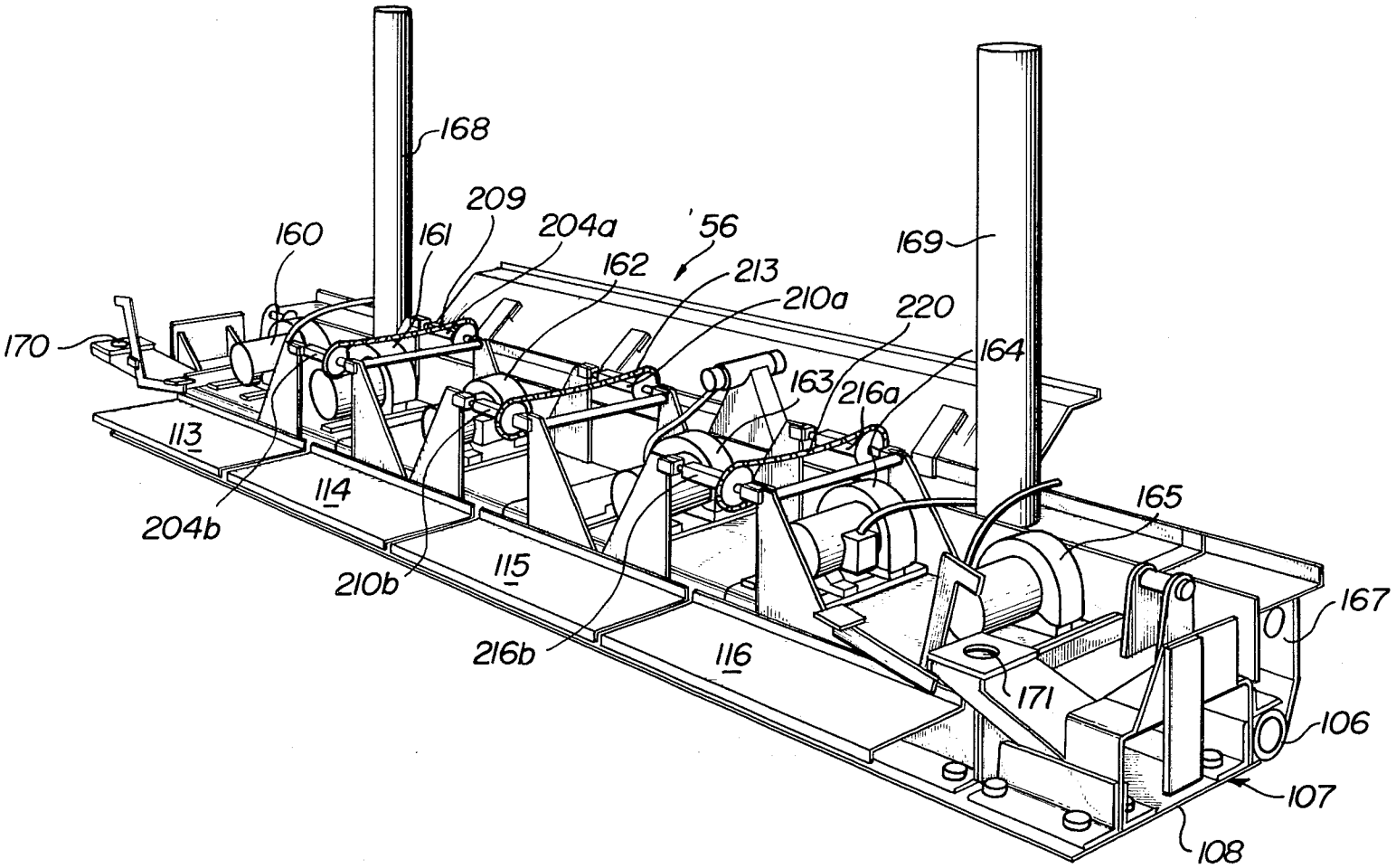
FIG. 8 is a perspective view of a leveling screed which is constructed in accordance with the aspects of this invention.
Figures 9, 10, 11:
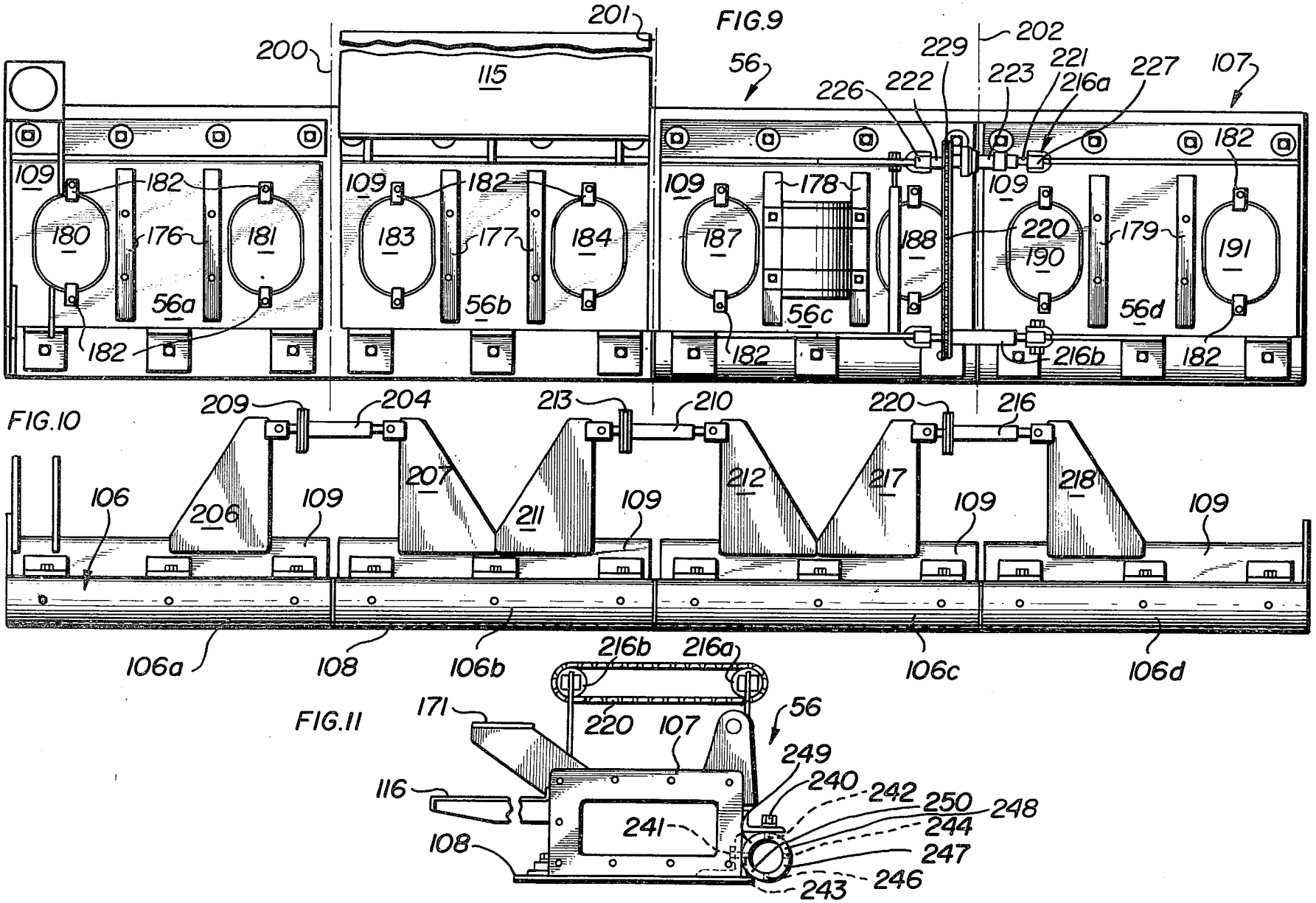
FIG. 9 is a top view of the screed.
FIG. 10 is a front view of the screed.
FIG. 11 is an end view of the screed.

The ends of the screed include socket structures 170 and 171 to receive adjusting screws similar to the adjusting screw 110 illustrated in FIG. 5. As best seen in FIGS. 9 and 10, the screed sections 56*a*–56*d* are disposed in closely adjacent side-by-side relationships for bracing the bottom plate 108 and disposing it in a desired road surface-forming shape. The section 56*a* includes a pair of vibrator mounting brackets 176 and the section 56*b* includes a pair of vibrator mounting brackets 177. Similarly, the section 56*c* includes vibrator mounting brackets 178 and the section 56*d* includes vibrator mounting brackets 179. While only four sections and four pairs of mounting brackets are shown in FIGS. 9 and 10, it will be understood that six vibrators can be incorporated as shown in the perspective view of FIG. 8. Any number of sections similar to the sections 56*a*–56*d* can be incorporated. For example, four to eight sections can be provided, depending on the width of the road repaving apparatus. The section 56*a* has a pair of access plates 180 and 181 secured over access apertures in its top member 109 by lock tabs and bolts indicated generally by reference numeral 182. The sections 56*b*–56*d* have similar pairs of access plates 183 and 184, 187 and 188 and 190 and 191, secured over openings in their top members 107 by means of lock similar tabs and bolts.

As explained above, and in accordance with the invention, the sections 56*a*–56*d* are adjustable relative to one another and the plate 108 is sufficiently flexible to allow the sections to be relatively pivotable about axes between the sections indicated by reference numerals 200, 201 and 202. This enables the screed plate 108 to be adjustably curved or arched so as to conform to the desired crown of the road surface.

To adjust the section positions, the sections 56*a* and 56*d* are tied together at their upper ends by turnbuckle means 204 which extends between a pair of upstanding plates 206 and 207 on the sections 56*a* and 56*b*, respectively. The turnbuckle means 204 includes forward and rear turnbuckle elements 204*a* and 204*b*, as seen in FIG. 8, which are coupled by a drive chain 209 which can be either manually or automatically driven to rotate the turnbuckles 204*a* and 204*b* simultaneously so as to effect uniform flexure of the forward and rear portions of the sections 56*a* and 56*b*.

Sections 56*b* and 56*c* are adjustably connected by turnbuckle means 210 extending between upstanding plates 211 and 212. The turnbuckle means 210 also includes a forward turnbuckle 210*a* and a rear turnbuckle 210*b*, as seen in FIG. 8, and these turnbuckles are tied together by a common drive chain and sprocket arrangement indicated generally by reference numeral 213. The sections 56*c* and 56*d* are also adjustably secured together by additional turnbuckle means 216 mounted between upstanding plates 217 and 218. The turnbuckle means 216 includes a forward turnbuckle 216*a* and a rear turnbuckle 216*b* tied together by a chain and sprocket arrangement 220.

The details of only one of the turnbuckles will be set forth herein, it being understood that the turnbuckles are all constructed in substantially the same manner. The turnbuckle 216*a* includes a pair of threaded shafts 221 and 222 extending from a threaded body 223. The shafts 221 and 222 are secured to brackets 226 and 227, respectively, mounted at the top ends of the plates 217 and 218. The brackets 226 and 227 preferably are welded in position. The treaded member 223 has fixed to it a sprocket 229 engaging a chain to form the sprocket and chain adjusting arrangement 220. By operating this turnbuckle, the plate 108 is flexed about the axes 200, 201 and 202 to obtain the desired curvature.

In accordance with another aspect of this invention, the leading edge of screed 56 is formed by the aforementioned pipe or edge member 106, which, as seen in FIG. 10 comprises separate sections 106*a*, 106*b*, 106*c* and 106*d* are respectively incorporated in the screed sections 56*a*–56*d*. As seen in FIG. 11, the pipe sections 106*a*–106*d* are secured to the screed sections by bolts 240 which engage threaded apertures 242, 243, respectively, formed within the pipe. A second set of threaded apertures 244 and 246 are formed diametrically opposed from the apertures 240 and 241, respectively. This enables the pipe or edge member sections to be removed from the position shown in the drawings, rotated 90°, and then resecured in a position at the leading edge of the screed. In this instance, the pipe would be secured by the threaded apertures 242 and 244 when rotated counter-clockwise 90°, or secured by threaded apertures 242 and 246 when rotated clockwise 90°. Thus, the pipe is capable of providing multiple wear surfaces for engaging the abrasive asphalt concrete material as the repaving machine passes over the road surface. For example, the quadrant designated by reference numeral 247 is the wear surface presently disposed for engaging the asphalt concrete material during the repaving operation. However, when the quadrant 247 is substantially worn, the pipe edge member can be moved and rotated to expose a new quandrant 248. Similarly, when this wear surface is depleted, the pipe or edge member may again be rotated to expose another new wear surface 249. Finally, a last wear surface 250 may be put into operation by again rotating the pipe. The screed 56 therefore provides a multiple wear surface device at the leading edge of the screed compacting plate or bottom wall 108.

Figure 12:
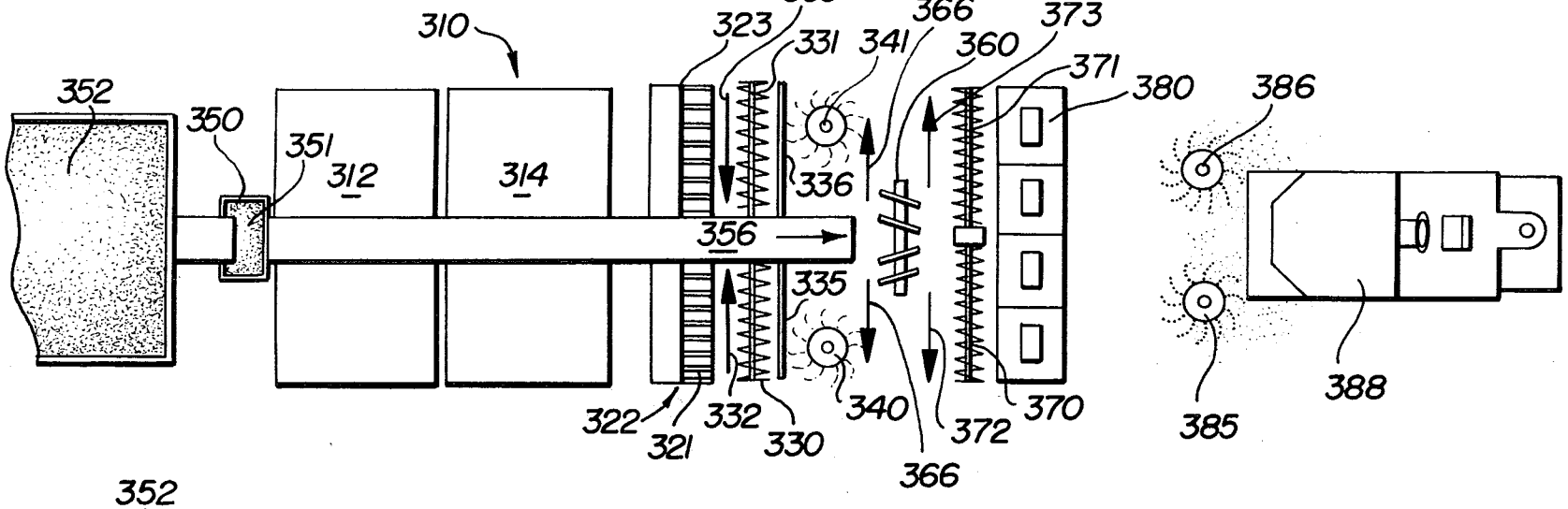
FIG. 12 is a top view showing in schematic form another embodiment of the invention.
Figure 13:
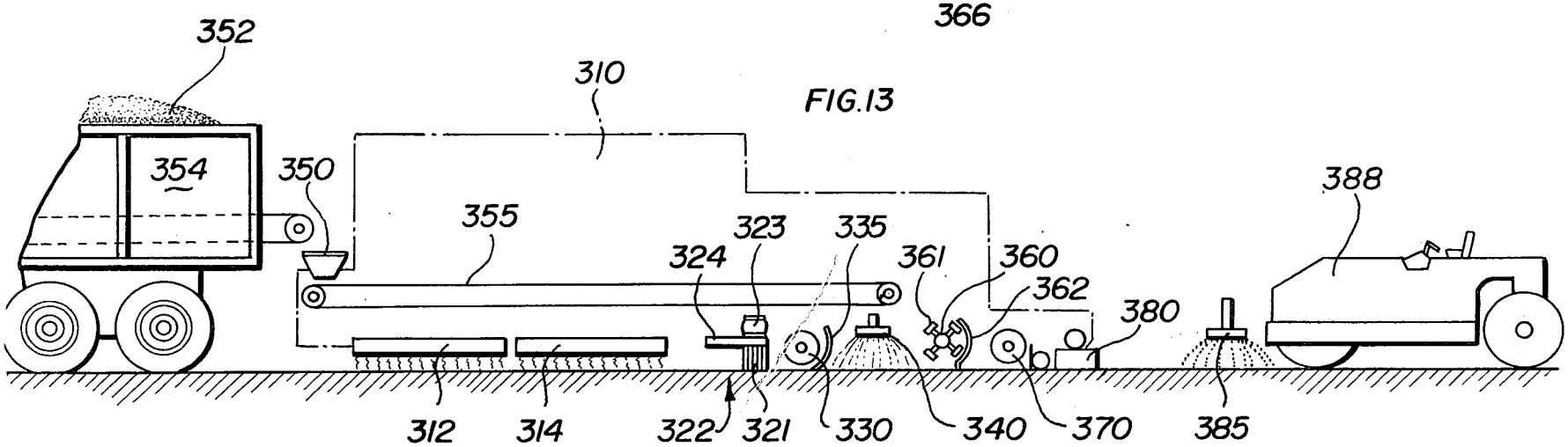
FIG. 13 is a side elevational view of the schematic showing of FIG. 12.

An alternate embodiment of the invention is illustrated in FIGS. 12 and 13. Here a machine 310 embodying the invention includes preliminary heaters 312 and 314 like those described in connection with FIG. 1-3. Nozzles (not shown) can be included if desired to apply a preliminary coating of liquid asphalt to the heated pavement if road conditions require. These nozzles can be conveniently located between the heaters 312 and 314 or behind the second heater 314. Scarifying blades 321, mounted at a scarifying station 322 are urged against the road surface by air operating bags 323 which apply pressure to scarifying blade holding arms 324. As noted above, the scarifying blades and air bag operating controls are described and illustrated in my copending application Ser. No. 467,067, filed May 6, 1974, now U.S. Pat. 3,907,450.

Behind these scarifying blades 321 are windrowing augers 330 and 331 which are arranged and rotated so as to convey the now-loosened and scarified material toward the center of the machine travel path as indicated by the arrows 332 and 333 in FIG. 12. Blades 335 and 336 mounted behind the augers 330 and 331 respectively assist in presenting scarified material to the augers for this centralized movement. Behind the augers 330, 331 and blades 335 and 336, liquid dispensers 340 and 341 apply hot liquid asphalt and any desired rejuvenating agent to the scarified and now relatively denuded remaining highway surface. These dispensers can be arranged, if desired, to also add asphalt to the scarified and windrowed material.

At the front or any other convenient location upon the machine 310, a receiving hopper 350 is located to receive a quantity of hot mix 351 from a supply 352 in a truck 354 or other delivery unit. This hot mix 351 is conveyed from the receiving hopper 350, as by a conveyor 355, to a delivery and dispersing position 356. At this position, the newly delivered hot mix 351 is deposited atop the material scarified and windrowed by the blades 321 and augers 330, 331. A pug-mill agitator device 360, here comprising a series of pug-mill paddles 361 and an associated backup plate 362, agitates and intermingles this newly delivered hot mix 351 and old road material to provide a new road-forming composition. If desired, this pug-mill rotor 360 can be formed so as to provide a spreading action to the composition as indicated by the arrows 365 and 366.

Behind the agitating pug-mill rotor 360, additional spreader augers 370 and 371 are oriented and are rotated so as to further spread and level the new composition as indicated by the arrows 372 and 373. A screed mechanism 380, which can be of the type described above, is provided to level and preliminarily compact this compositon into a new road surface. Material spreaders 385 and 386 can be provided to scatter a layer of nonskid synthetic aggregate atop the new road surface. It will be understoood that a roller vehicle 388 or other compactor device can be used to achieve 100% of the desired compaction for the newly rejuvenated asphalt concrete material and recycled road.

From the foregoing, it is seen that the present invention provides a new and improved road repaving method and machine for rejuvenating an old road surface substantially completely. Also, the machine provides a screed which can be contoured to correspond to the crown of the road and which screed substantially compacts the asphalt concrete material to a preliminary compaction which can be on the order of 85% or more. Accordingly, it will be understood that variations and modifications of this invention may be effected without departing from the novel concepts as set forth in the following claims.

Figure 14:
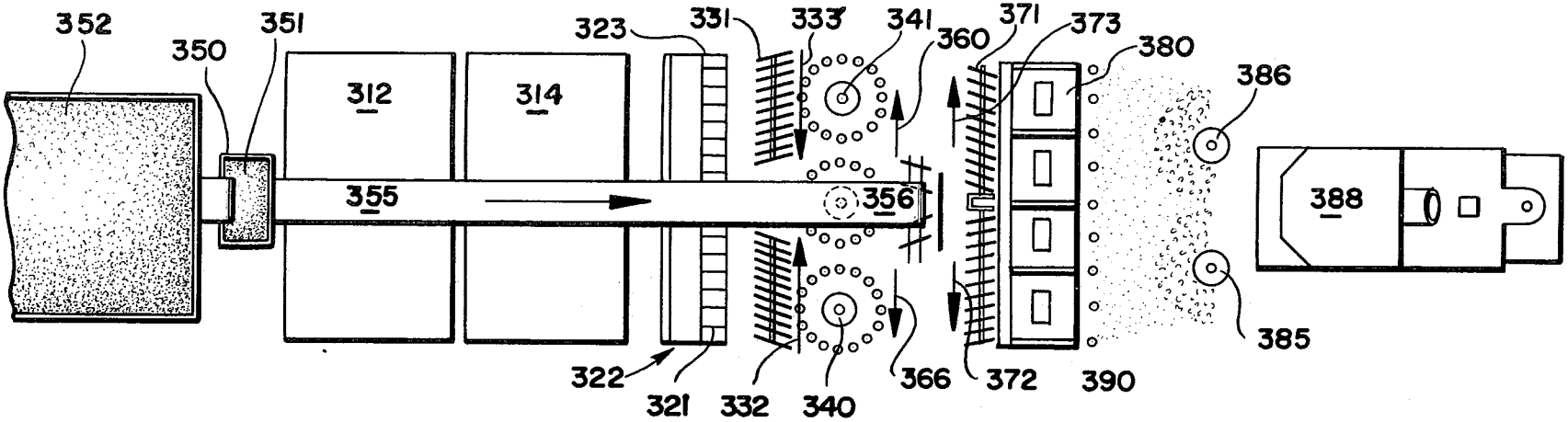
FIG. 14 is a top plan view in schematic form of a modified version of the invention.
Figure 15:
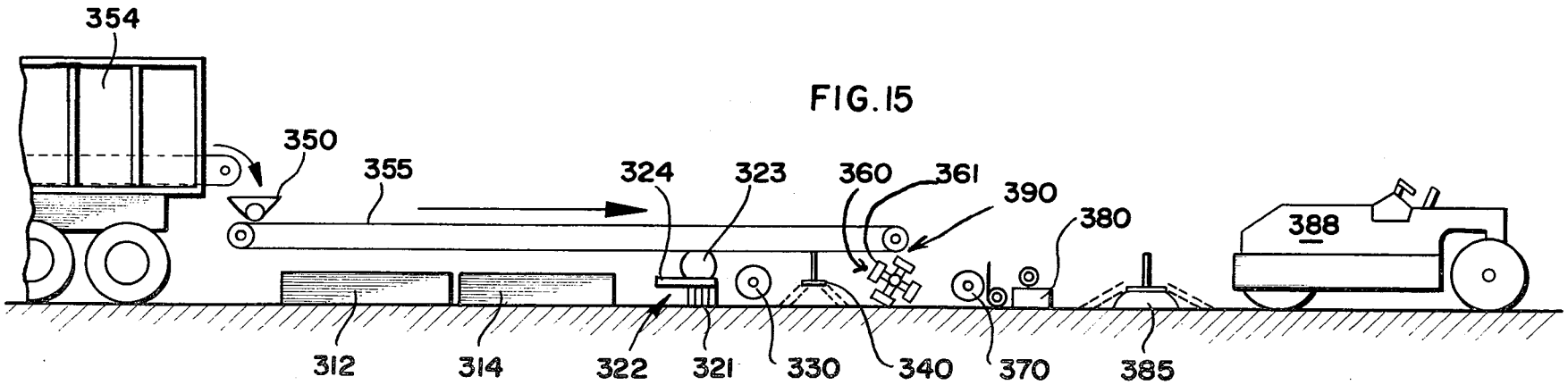
FIG. 15 is a side elevational view in schematic form, of the modified version of the invention shown in FIG. 14.

A slightly modified version of the embodiment of the invention is illustrated in FIGS. 14 and 15. Here, old asphalt material is heated by the heaters 312 and 314, and scarified by the blades 321 at the station 322. Windrowing augers 330 and 331, collect the old material along a central location. Behind the augers 330, 331, liquid dispensers 340 and 341 apply hot liquid asphalt and any desired rejuvenating agent to the scarified and relatively cleared remaining highway surface.

A receiving hopper 350 (here conveniently located at the front of the machine) receives a quantity of new hot mix 351 from a supply 352 in a truck 335 or other delivery unit. This new hot mix 351 is carried by a conveyor 355 from the hopper 350 to a dispensing station 390 above the pug-mill agitator 360.

It will be noted that the pug-mill 360 is positioned to receive not only the new hot mix 351, but also to engage the old, windrowed hot mix. In this way, positive mixing of the old and new portions of the asphalt hot mix is accomplished. Further mixing occurs as the mix reaches and is spread by the spreader augers 370 and 371, as indicated by the arrows 372 and 373. The screed mechanism 380 levels and preliminarily compacts the material into the new, rejuvenated road surface. Material spreaders 385 and 386 scatter a layer of nonskid synthetic aggregate atop the road surface. The roller 388 or other compactor can be used to provide 100% of the desired compaction for the rejuvenated, recycled road.

The invention is claimed as follows:

1. A method of restoring an asphalt road, comprising the steps of: scarifying an existing roadway surface to a predetermined depth to obtain loosened road material collecting the loosened road material in a single, centralized windrow, applying asphalt to the loosened windrow material to form a rejuvenated asphalt mix over the road surface, adding new asphalt mix to the rejuvenated asphalt mix, pug-milling the new and rejuvenated mixes, and compacting the pug-milled new and rejuvenated asphalt mixes to form a new road surface.

2. A method of restoring a roadway as set forth in claim 1 further including the step of heating the surface of the roadway prior to scarifying the same.

3. A method of restoring a roadway as defined in claim 1 further including the step of vibrating the pug-milled new and rejuvenated asphalt mixes as it is being compacted.

4. A method of restoring an asphalt roadway comprising the steps of: heating an upper layer of an existing roadway, scarifying the heated layer for obtaining a substantial quantity of loose existing road material, collecting the loose existing road material in a centralized windrow, spraying liquid asphalt upon the loose material, applying liquid rejuvenating material in addition to said liquid asphalt to the loose material, adding new asphalt mix to the windrow and thereafter pug-milling the loose existing material and new asphalt mix and rejuvenating material on the roadway, and spreading the mixed loose material and liquid asphalt on the roadway.

5. A method of restoring a roadway as set forth in claim 4 which includes the step of applying a film of liquid asphalt to the surface of the existing roadway prior to the step of scarifying.

6. A method of restoring a roadway as defined in claim 4 which includes the step of applying liquid rejuvenating material in addition to said liquid asphalt to the material and thereafter mixing and spreading the mixture.

7. A method of restoring an asphalt roadway as defined in claim 6 which includes the step of forming the mixed and spread material to provide the roadway with a predetermined crowned surface configuration.

8. A method of restoring an asphalt roadway as defined in claim 7 which includes the step of vibrating and compacting the spread mixture.

9. A screed structure for use in apparatus of the type described comprising a bottom plate member engageable with a surface to be processed, a front edge member adjustably fixed in one of a number of positions along a forward edge of said plate member, said front edge member including a plurality of circumferentially spaced wear surface portions, and means adjustably fixing said front edge member for enabling said wear surface portions to be selectively rotated so as to present an undamaged wear surface for engagement with a surface being processed.

10. A screed structure as defined in claim 9 wherein said bottom plate member is of substantial predetermined length, said screed structure including a plurality of means interconnected with successive sections of said plate member for adjustably deflecting said successive sections with respect to each other for shaping the plate member in accordance with a desired configuration of a surface being processed, and said screed structure including a plurality of said front edge members respectively associated with said bottom plate member sections.

11. Apparatus for restoring a roadway, comprising mobile frame means, means on the frame means for excavating the roadway surface, means for heating the excavated surface, means on the frame means for applying a quantity of asphalt to the excavated heated surface to form a rejuvenated asphalt mix, and vibrating screed means attached to the frame means for compacting the rejuvenated asphalt mix, said vibrating screed means including a yieldable bottom plate, and means for flexing the yieldable bottom plate in accordance with the radius of curvature of the road surface being restored to form a crown for the road surface, said bottom plate including a removable edge member carried in an initial position to provide an initial wear surface for said screed, and means for removing said leading edge member and replacing same when worn in another position on the screed means in a positon rotated from the initial position to provide a new, undamaged wear surface for said screed.

12. Apparatus for restoring a roadway as set forth in claim 11 wherein said removable leading edge of said screed includes a pipe, said pipe including apertures extending therethrough for mounting said screed in a first orientation and apertures in said pipe for mounting said screed in a second orientation, said second orientation forming a new wear surface for the leading edge of said screed.

13. Apparatus for restoring the roadway as set forth in claim 12 wherein said apertures in said pipe are positioned in quadrature relation, and wherein said pipe is adapted to be rotated in increments of 90° to provide four wear surfaces for the leading edge of said screed.

14. Apparatus for restoring a roadway as set forth in claim 11 wherein said means for flexing said yieldable bottom plate includes upstanding brackets secured to a plurality of independent sections forming said screed, each of said sections being secured to said yieldable bottom plate, and turnbuckle means secured between said upstanding brackets for urging said independent sections toward or away from one another to bend said bottom plate in accordance with the radius of curvature of the road surface being restored.

* * * * *